US009232839B2

(12) United States Patent
Hein

(10) Patent No.: US 9,232,839 B2
(45) Date of Patent: Jan. 12, 2016

(54) CURLING IRON APPARATUS WITH RELEASABLE CLAMP

(71) Applicant: Conair Corporation, Stamford, CT (US)

(72) Inventor: Duane Charles Hein, Monroe, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 14/199,059

(22) Filed: Mar. 6, 2014

(65) Prior Publication Data

US 2015/0250279 A1 Sep. 10, 2015

(51) Int. Cl.

| | |
|---|---|
| ***A45D 1/00*** | (2006.01) |
| ***A45D 2/40*** | (2006.01) |
| ***A45D 1/04*** | (2006.01) |
| ***A45D 1/28*** | (2006.01) |
| *A45D 1/10* | (2006.01) |
| *A45D 1/14* | (2006.01) |

(52) U.S. Cl.
CPC .. *A45D 1/04* (2013.01); *A45D 1/28* (2013.01); *A45D 1/10* (2013.01); *A45D 1/14* (2013.01); *A45D 2001/045* (2013.01)

(58) Field of Classification Search
CPC ..... A45D 1/00; A45D 1/02; A45D 1/04; A45D 1/06; A45D 2/00; A45D 2/001; A45D 2/367; A45D 6/045
USPC ..... 132/263, 229, 231, 234, 232, 224, 225; 219/225
See application file for complete search history.

(56) References Cited

U.S. PATENT DOCUMENTS

| | | | | |
|---|---|---|---|---|
| 1,448,754 | A | 3/1923 | Langos | |
| 1,482,403 | A * | 2/1924 | Leonard | 132/263 |
| 1,483,402 | A * | 2/1924 | Wolcott | 132/263 |
| 1,546,046 | A * | 7/1925 | Thompson, Jr. | 132/263 |
| 1,579,952 | A * | 4/1926 | Rankin | 132/263 |
| 1,630,766 | A | 5/1927 | Rutenber | |
| 1,904,043 | A * | 4/1933 | Frank et al. | 132/234 |
| 2,584,999 | A | 2/1952 | Flournoy | |
| 2,589,510 | A * | 3/1952 | Ratner et al. | 132/263 |
| 3,859,497 | A | 1/1975 | McNair | |
| 4,024,375 | A | 5/1977 | Olesen et al. | |
| 4,032,747 | A | 6/1977 | Kunz | |
| 4,139,014 | A * | 2/1979 | Rowland | 132/118 |
| 4,270,554 | A | 6/1981 | Lazzaro | |
| 4,641,010 | A | 2/1987 | Abura et al. | |
| 5,223,694 | A | 6/1993 | Tsuji et al. | |

(Continued)

OTHER PUBLICATIONS

International Search Report for PCT/US13/72177, mailed Jun. 24, 2014, 3 pages.

(Continued)

*Primary Examiner* — Robyn Doan
(74) *Attorney, Agent, or Firm* — Carter, DeLuca, Farrell & Schmidt, LLP

(57) ABSTRACT

A hair curling apparatus includes a handle, a barrel depending from the handle, and dimensioned to accommodate a lock of hair wrapped thereabout and a clamp releasably mounted relative to one of the barrel or the handle. The clamp includes a spoon which is adapted to move relative to the one of the barrel or the handle between a closed position and an open position. The spoon engages the lock of hair when in the closed position. The curling iron apparatus has both clamp and clampless capabilities, thus providing the user with styling flexibility.

16 Claims, 9 Drawing Sheets

(56) References Cited

U.S. PATENT DOCUMENTS

| | | | |
|---|---|---|---|
| 5,400,810 | A | 3/1995 | Taylor |
| 5,584,307 | A | 12/1996 | Bauer et al. |
| 5,884,635 | A | 3/1999 | O'Brien et al. |
| 6,047,707 | A | 4/2000 | Johnson |
| 6,138,685 | A | 10/2000 | O'Brien et al. |
| 6,554,000 | B2 | 4/2003 | Lin |
| 6,627,852 | B1 | 9/2003 | Savone |
| 6,667,462 | B2 | 12/2003 | Lo |
| 6,895,975 | B2 | 5/2005 | Hafemann |
| 6,920,886 | B2 | 7/2005 | McCambridge et al. |
| 7,044,139 | B2 | 5/2006 | Tong |
| D547,903 | S | 7/2007 | Rizzuto, Jr. |
| 7,271,368 | B2 | 9/2007 | Yeung |
| D596,792 | S | 7/2009 | Kwok |
| 7,631,646 | B2 | 12/2009 | Ragosta et al. |
| D618,394 | S | 6/2010 | Keong |
| D659,284 | S | 5/2012 | Amkie |
| 2005/0022836 | A1 | 2/2005 | Tong |
| 2005/0150511 | A1 | 7/2005 | Park |
| 2005/0199257 | A1 | 9/2005 | Hafemann |
| 2006/0076032 | A1 | 4/2006 | Fung |
| 2007/0267037 | A1 | 11/2007 | Hur |
| 2008/0035167 | A1 | 2/2008 | Chan |
| 2008/0173322 | A1 | 7/2008 | Leung |
| 2009/0032048 | A1 | 2/2009 | Suzuki et al. |
| 2011/0100391 | A1 | 5/2011 | Paolacci |
| 2011/0226278 | A1 | 9/2011 | Rivola et al. |
| 2012/0111357 | A1 | 5/2012 | Amkie |
| 2012/0145180 | A1 | 6/2012 | Rong |
| 2014/0060569 | A1* | 3/2014 | Kim ..... 132/254 |

OTHER PUBLICATIONS

International Search Report Application No. PCTUS15/19176, dated Jun. 12, 2015.

* cited by examiner

CURLING IRON APPARATUS WITH RELEASABLE CLAMP

BACKGROUND

1. Technical Field

The present invention relates to a curling iron. More particularly, the present invention relates to a curling iron including a releasable clamp permitting the user to style hair with or without the presence of the clamp on the curling iron.

2. Background of the Related Art

Heated hair may be smoothed, manipulated, and styled more easily that non-heated hair. There are numerous hair styling tools and appliances for heated styling of hair including curling irons having a variety of features. Curling irons are intended to impart a curl or pattern to hair being styled by sufficiently heating a barrel or mandrel of the curling iron and restraining the hair in physical contact with the barrel. A section of hair is typically wound around the heated barrel of the curling iron and held in contact with the heated barrel for a period of time. Heat from the heated barrel reforms plastic bonds in the hair. When the heat styled hair is removed from the heated barrel, the hair retains the shape of the curling iron's barrel.

One conventional curling iron utilizes a clamp to hold hair in place along the barrel of the curling iron. The clamp secures a starting section of hair with subsequent windings of the hair being wound on top of the clamp and the barrel, locking the clamp against the barrel. Thus, the hair must be unwound to release the clamp. Unfortunately, unwinding the hair from the barrel reduces the set of the curl and the precision of the set.

In recent years, clampless curling irons have become available. A clampless curling iron provides additional flexibility and benefits over conventional curling irons including, e.g., the ability to wrap hair directly over the barrel while keeping the barrel stationary, eliminating creases and crimps in the hair associated with the clamp, and enabling the curling iron to get closer to the roots thereby creating an increased volume in the curl.

SUMMARY

Accordingly, the present disclosure is directed to a curling iron having both clamp and clampless capabilities, thus providing the user with styling flexibility. In one embodiment, a hair curling apparatus includes a handle, a barrel depending from the handle, and barrel dimensioned to accommodate a lock of hair wrapped thereabout and a clamp releasably mounted relative to one of the barrel or the handle. The clamp includes a spoon which is adapted to move relative to the one of the barrel or the handle between a closed position and an open position. The spoon engages the lock of hair when in the closed position.

The clamp includes a spoon mount dimensioned to releasably couple with the barrel. The spoon may be pivotally mounted to the spoon mount. The spoon mount may include a mount base and a lock mounted for movement relative to the mount base. The lock is adapted to move between a release position and a secured position thereof. The lock may be pivotally mounted to the mount base, and is pivotal between the release position and the secured position. The lock may include a lock detent and the mount base may include a lock shelf. The lock detent may be dimensioned to engage the lock shelf when in the secured position of the lock.

The barrel may define a recessed barrel segment having a reduced cross-section. The mount base may be at least partially accommodated within the recessed barrel segment when the clamp is mounted to the barrel. One of the barrel and the mount base may include a key and the other of the barrel and the mount base may include a key slot dimensioned to receive the key when the clamp is mounted to its barrel.

The spoon may be normally biased to the closed position by a spring.

BRIEF DESCRIPTION OF THE DRAWINGS

Various embodiments of the present disclosure are described hereinbelow with references to the drawings, wherein.

DETAILED DESCRIPTION

Figure 1:
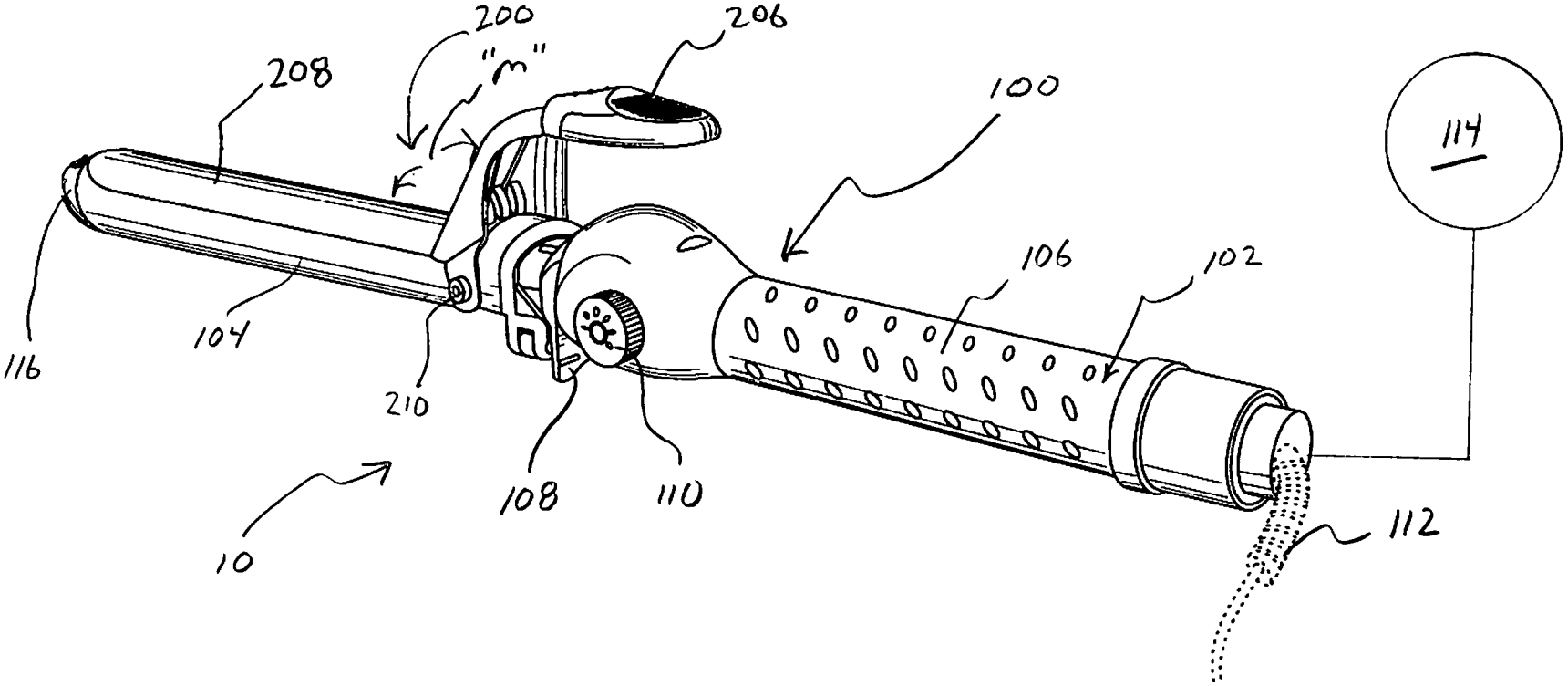
FIG. 1 is a perspective view of the curling iron apparatus of the present disclosure illustrating the curling iron and the releasable clamp mounted to the curling iron.

Referring to the figures and, in particular, FIGS. 1-4, there is illustrated a curling iron apparatus in accordance with the principles of the present disclosure, and generally represented by reference numeral 10. The curling iron apparatus 10 includes a curling iron 100 and a clamp 200 which is releasably mountable to the curling iron 100. The curling iron includes a handle 102 for safely manipulating the curling iron and a barrel 104 depending from the handle 12. The handle 102 is thermally insulated from the barrel 104 which is heated to style hair. The handle 102 may include surfaces that can be grasped and manipulated (e.g., turned) during the styling of hair. The handle 102 can have a soft-grip cover 106 and/or other features located in or on the handle 102 to facilitate comfortable and practical manipulation of curling iron 100. At the forward end of the handle 102 is an insulative cover 108 which further isolates the handle 102 from heat generated by the barrel 104. The handle 102 may include at least one knob 110. The knob 110 may be manipulated by the user to control the amount of heat or time of operation of the curling iron 100.

The curling iron 100 receives power from an electrical outlet via a power cord 112 which extends from the handle 102. Alternatively, the barrel 104 may be powered by, for example, a battery or other suitable sources of electrical power.

The barrel 104 may be made of any thermally conductive material adapted to transfer heat from a heater assembly identified schematically as referenced numeral 114 located in the curling iron 100. The barrel 104 may define a smooth cylindrical surface or may have one or more raised or depressed thermally conductive surfaces located thereon including, e.g., transverse ribs, a helical rib, and a raised pattern to impart a decorative crimp or wave pattern onto the hair. The barrel 104 includes an insulative tip 116 and defines a longitudinal barrel axis "z".

Figure 3:
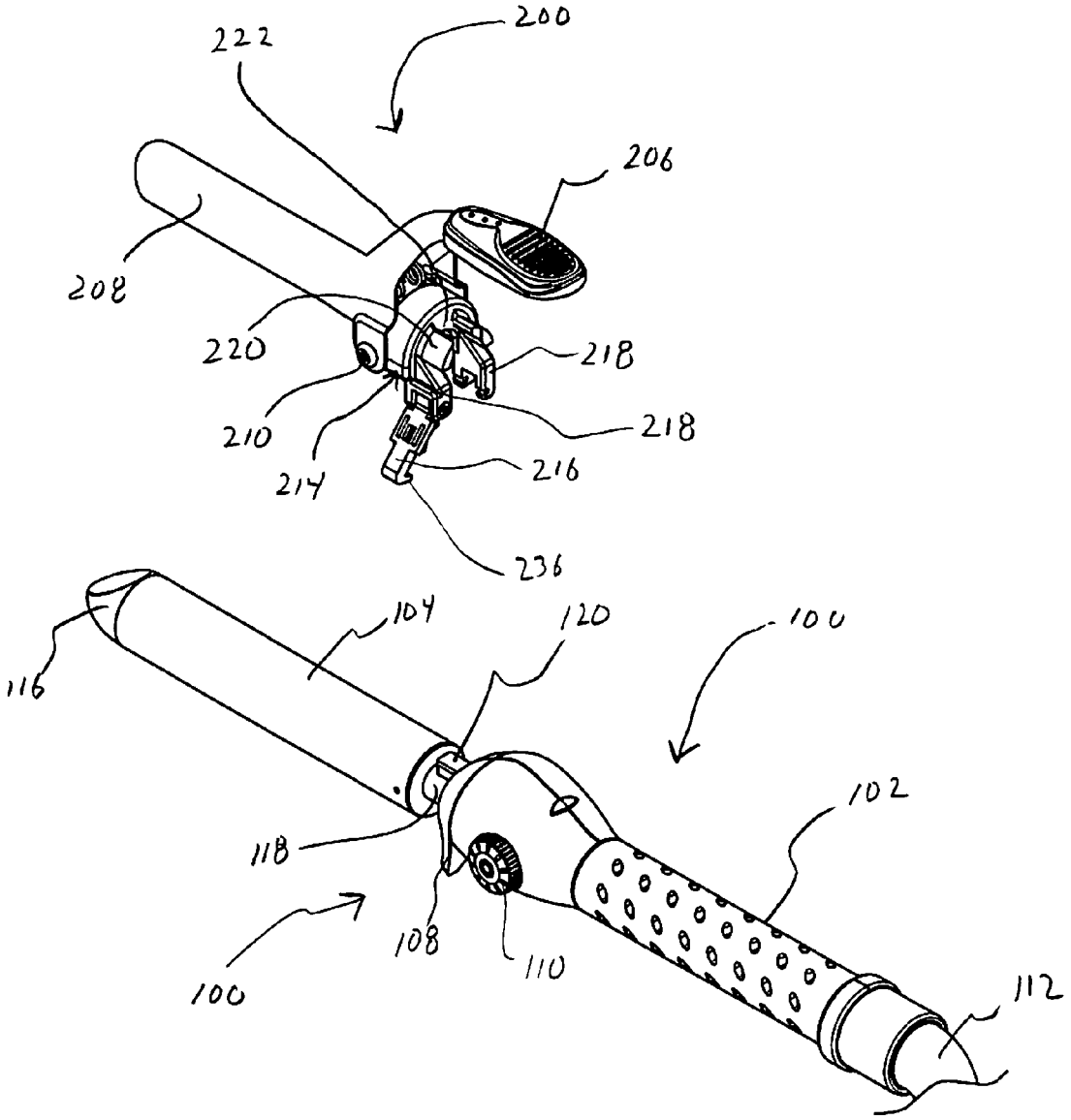
FIG. 3 is a perspective view of the curling iron apparatus illustrating the curling iron and the releasable clamp released from the curling iron.

As best depicted in FIG. 3, the barrel 104 includes a recess segment 118 adjacent the handle 102 dimensioned to cooperate with the clamp 200 to releasably secure the clamp 200 relative to the barrel 104. The recessed segment 118 defines a cross-sectional dimension or diameter which is less than the diameter of the remaining section of the barrel 104. A key 120 extends longitudinally along the recessed segment 118. The key 120 prevents rotational movement of the clamp 200 relative to the barrel 104 when the clamp 200 is mounted to the barrel 104.

The heater 114 within the barrel 104 may be any conventional heater assembly which can be incorporated within the barrel 104. The heater assembly 114 may include a controller, e.g., circuitry, to regulate the output of the heater assembly 114. The controller may have a micro-processor for controlling various functions of the heater assembly 114, and various types of feedbacks, comparators, and/or logic circuitry to monitor and respond to the variable temperature loads to which the curling iron 100 is likely subjected.

Figure 2:
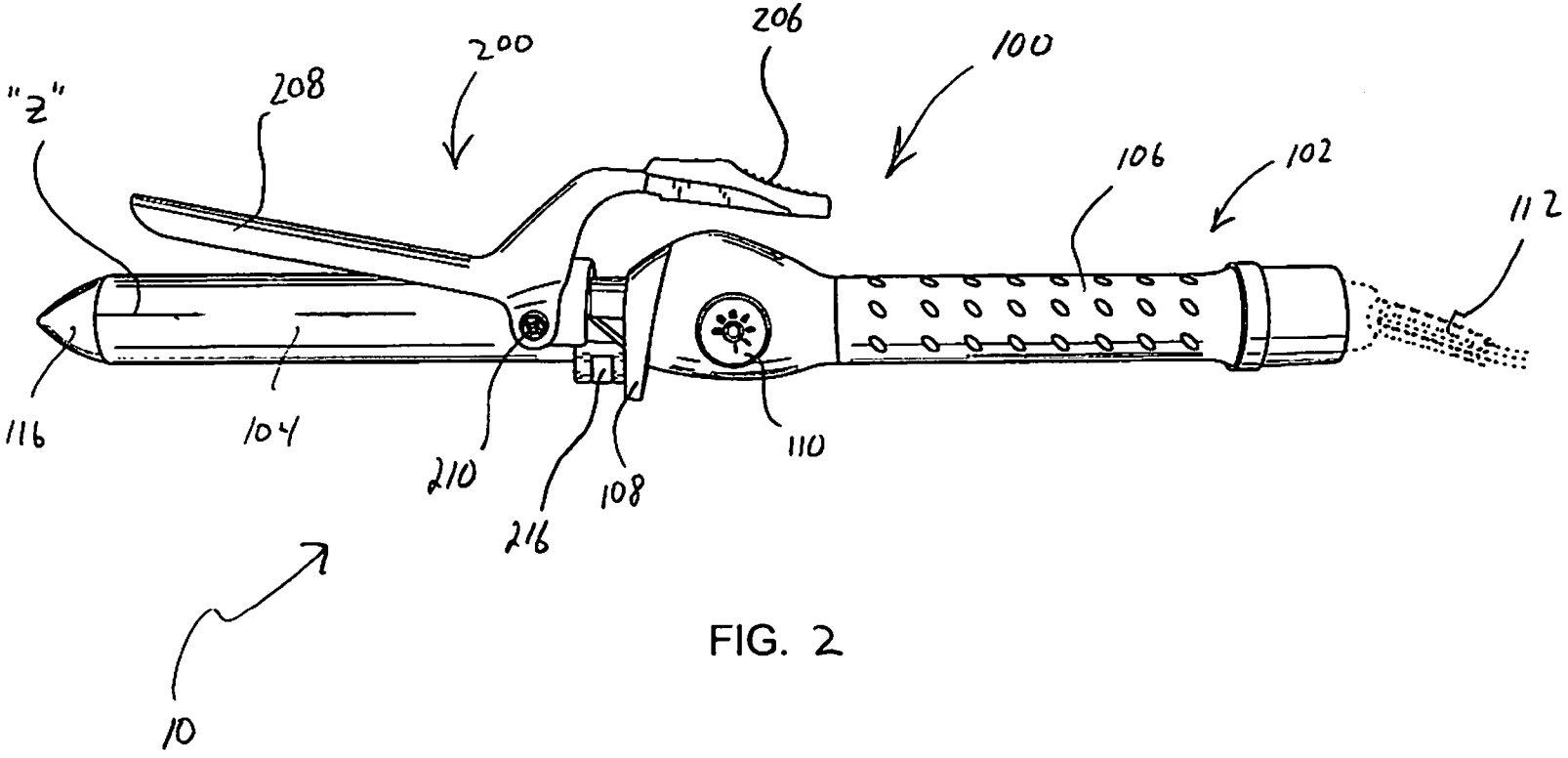
FIG. 2 is a side view of the curling iron apparatus with the releasable clamp in an open position.

With continued reference to FIGS. 1-4, the releasable clamp 200 will be discussed. The releasable clamp 200 includes a spoon 202 and a spoon mount 204 which is secured to the spoon 202. The spoon 202 includes a manual segment 206 and a hair segment 208 depending from the manual segment 206. The manual segment 206 is manipulated by the user to open and close the spoon 202. The spoon 202 is pivotally mounted to the spoon mount 204 via pivot pins or screws 210, and is adapted to pivot in direction of directional arrows "m" between a closed position adjacent the barrel 104 as depicted in FIG. 1 and an open position displaced from the barrel 104 as depicted in FIG. 2. The spoon 202 may be biased to the closed position by a torsion spring 212.

Figure 4:
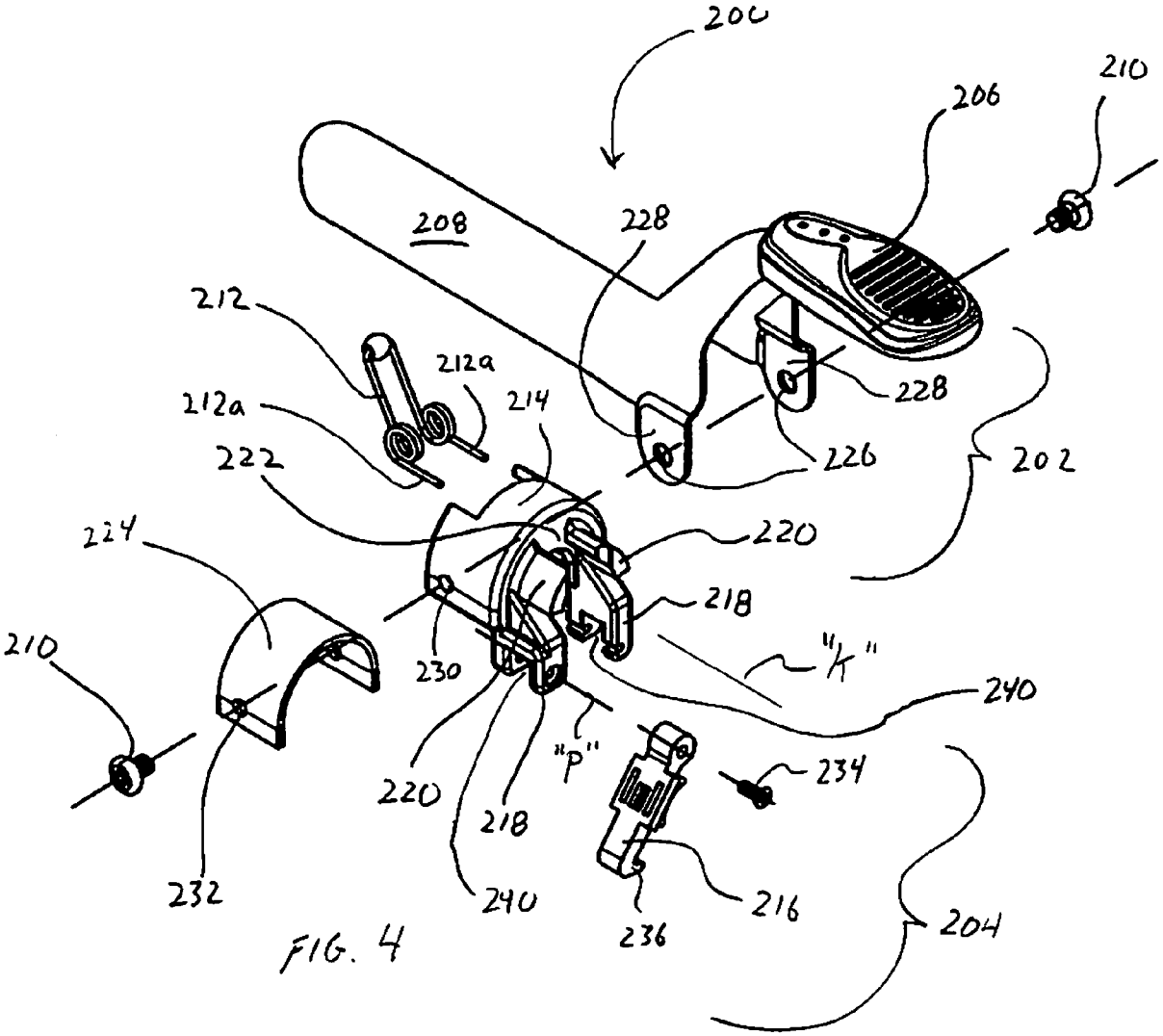
FIG. 4 is an exploded perspective view of the releasable clamp.

As best depicted in FIG. 4, in conjunction with FIG. 3, the spoon mount 204 includes a mount base 214 defining base axis "K" and a lock 216 which is mounted to the base 214. The mount base 214 includes first and second pairs of legs 218 depending transverse to the longitudinal axis "K". The legs 218 define a space therebetween which at least partially accommodates the lock 216. The mount base 214 further includes wall segments 220 defining a key slot 222 which receives the key 120 of the barrel 104 when the releasable clamp 200 is mounted to the barrel 104. The spoon mount 204 may include a spring mount 224 which is received within the interior of the spoon mount 204 in flush relation with an interior surface thereof. The spring mount 224 may secure one end of the torsion spring 212 relative to the spoon mount 204, e.g., the ends 212*a* of the torsion spring 212 may be secured between the spoon mount 204 and the spring mount 224. The spring mount 224 may add stability to the spoon mount 204 and/or be fabricated from an insulative material to isolate the spool mount 204 from heat.

The spoon mount 204 is secured to the spoon 202 via screws 210 which extend through openings 226 of mounting legs 228 of the spoon 202, through openings 230 of the mount base 214 and openings 232 of the spring mount 224. Either the openings 230, 232 of mount base 214 and the spring mount 224 may be threaded to threadably engage the screws 210. In one embodiment, the openings 232 of the spring mount 224 are threaded.

The lock 216 of the releasable clamp 200 is pivotally mounted to the base mount 214 via pivot pin or screw 234 which defines pivot axis "p". Pivot axis "p" is in substantial parallel relation with longitudinal barrel axis "z" of the barrel 104 and with longitudinal base axis "K" of mount base 214. The lock 216 defines a locking detent 236 which engages a corresponding lock shelf 238 of the mount base 214 as will be discussed. The lock 216 is adapted to pivot relative to the base mount 214 between an open position and a closed position. In the closed position, the lock is at least partially accommodated within a gap 240 defined with each mounting leg 218 of the mount base 214.

Figure 5:
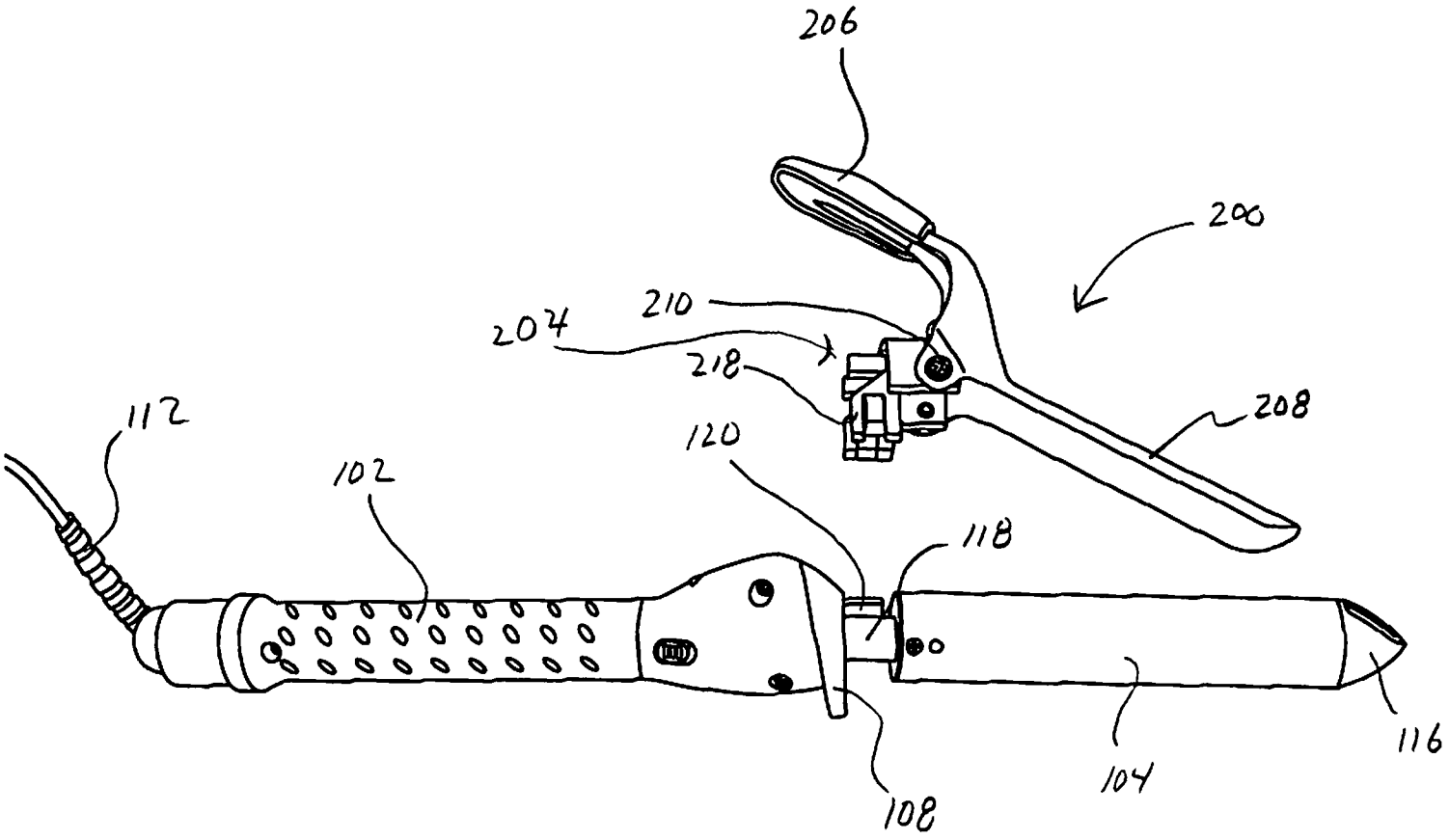
FIG. 5 is a side view of the curling iron and the releasable clamp released from the curling iron.
Figure 6:
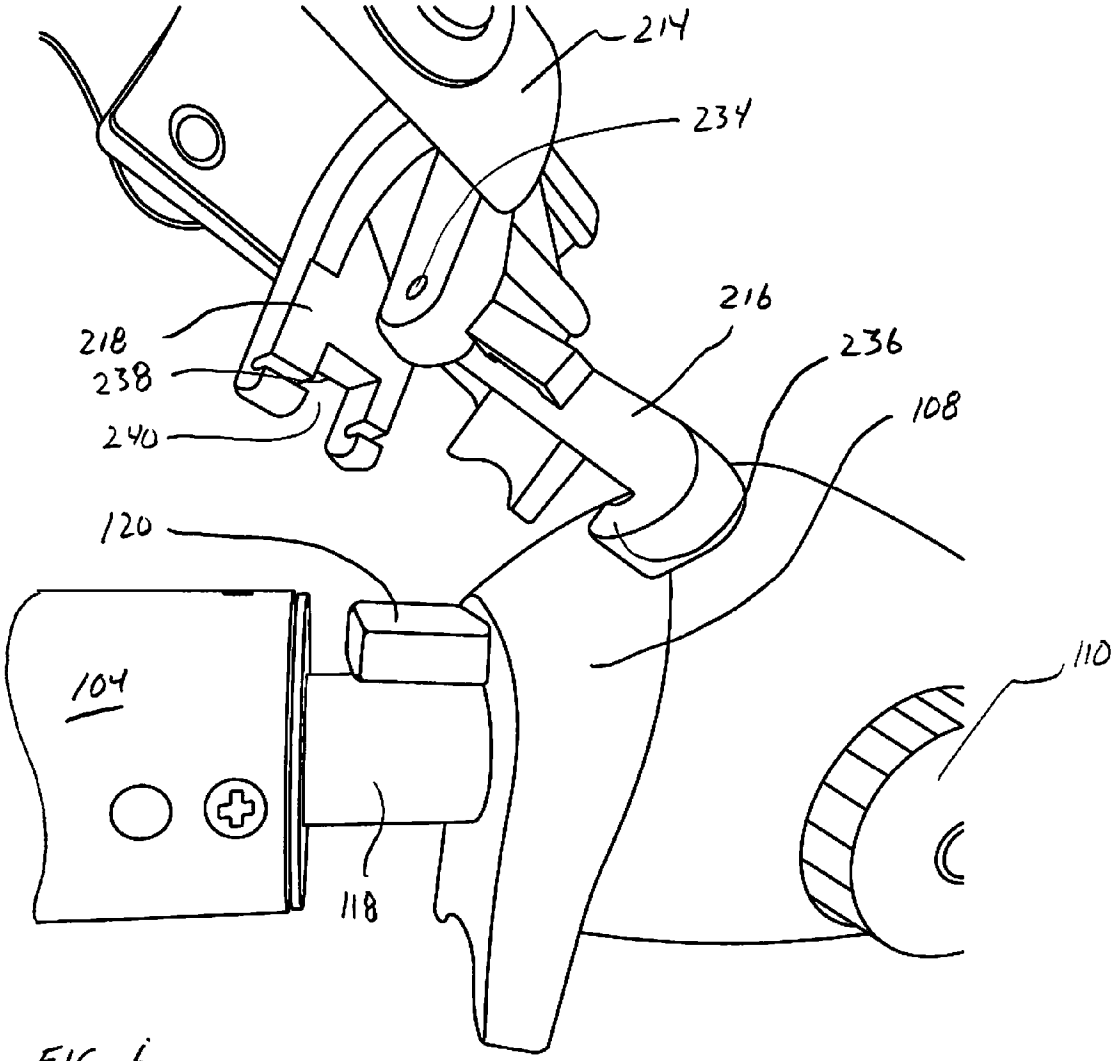
FIGS. 6-8 are views illustrating mounting of the releasable clamp to the curling iron.
Figure 7:
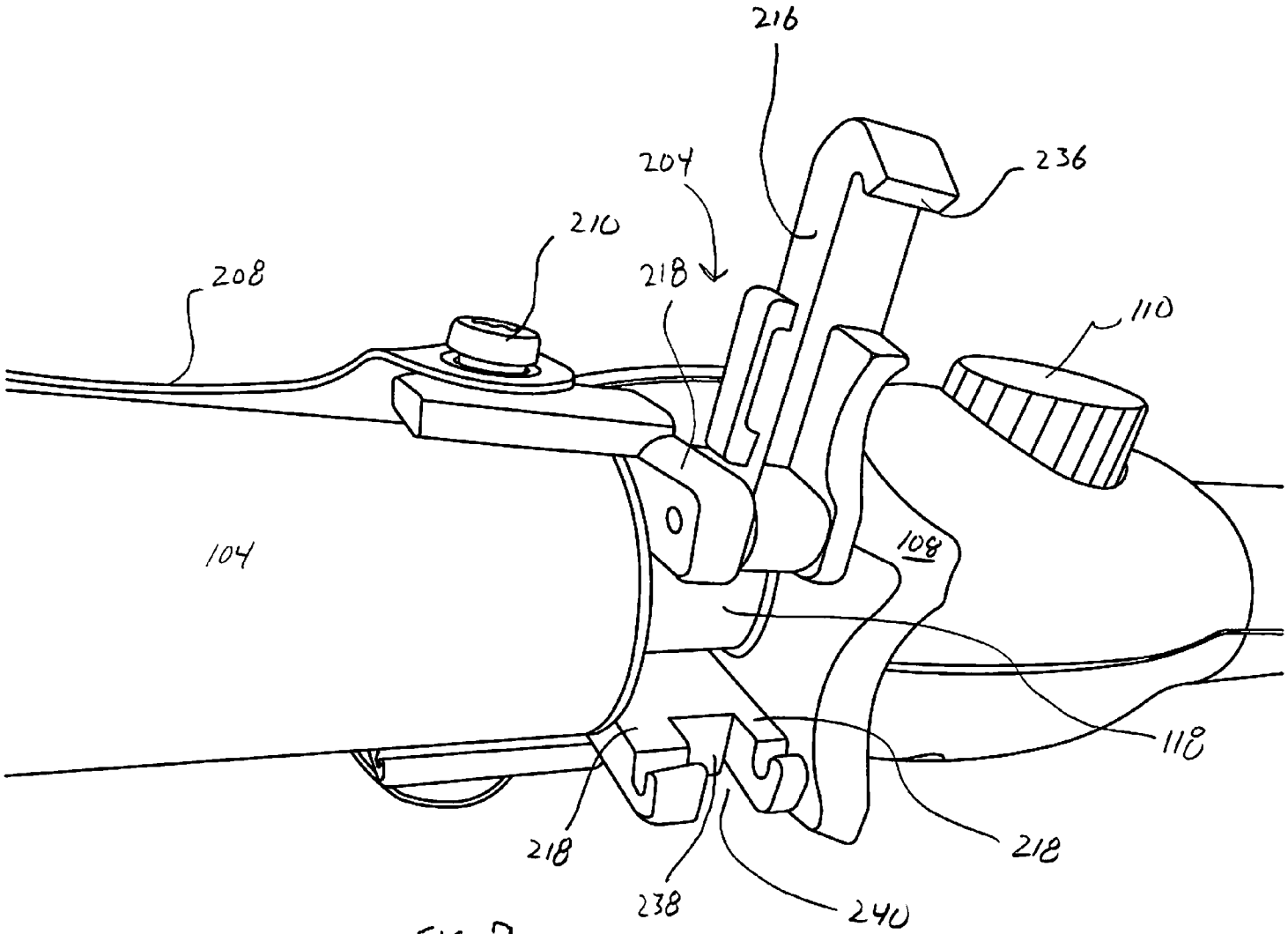

Assembly of the clamp 200 to the curling iron 100 will now be discussed. With reference to FIGS. 5 and 6, the spoon mount 204 is engaged and aligned over the recessed mounting segment 118 of the barrel 104. The key slot 222 in the mount base 214 is aligned with the key 120 on the barrel 104 (FIG. 3), and the spoon mount 202 is advanced onto the recessed segment 118 of the barrel 104 with the legs 218 straddling opposed sides of the recessed segment 118 and at least partially confined within the recessed segment 118 (FIG. 7). The key 120 on the barrel 104 is received within the key slot 222 of the mount base 214. The mount base 214 extends over the barrel 104 forward of the recessed segment 118. The mount base 214 defines an internal contour which matches the contour of the barrel 104.

Figure 8:
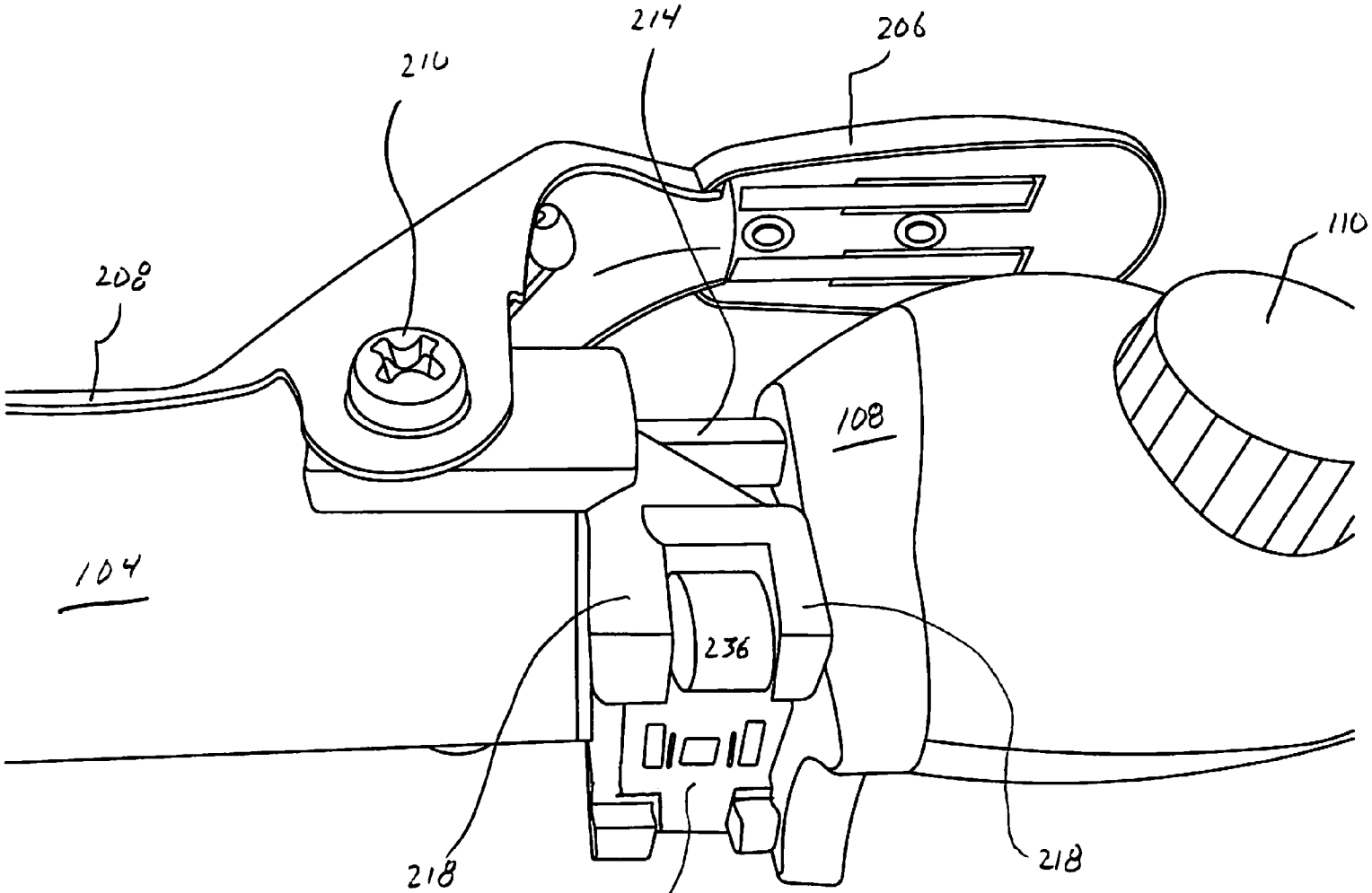
Figure 9:
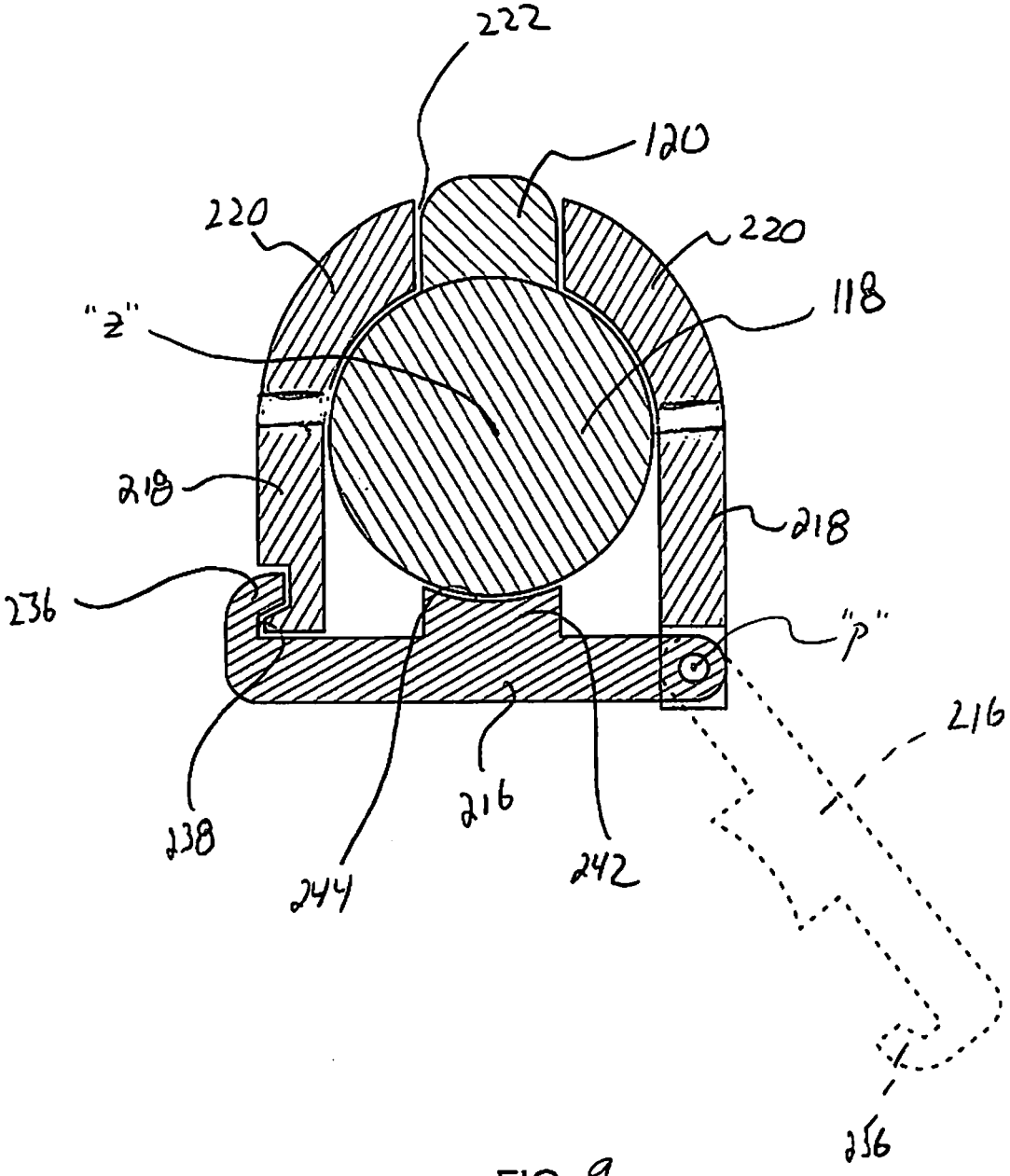
FIG. 9 is an axial cross-section view through the spoon mount of the curling iron.

To secure the releasable clamp 200, the lock 216 is moved from the release position depicted in FIG. 7 to the secured position depicted in FIG. 8, whereby the lock detent 236 snaps into engagement with the lock shelf 238 of the mount base 214. Either or both the lock detent 236 and the lock shelf 238 may be sufficiently resilient to permit passage of the lock detent 236 over the lock shelf 238 and return to secure the components relative to each other. FIG. 9 is a cross-sectional view through the mount base 214 and the lock 216. In FIG. 9, the lock 216 is shown in the secured position with the lock shelf 238. The release position of the lock 216 is shown in phantom. The spoon mount 204 is thus secured relative to the barrel 104 by reception of the key 120 of the barrel 104 within the key slot 222, which prevents rotational movement of the spoon mount 204 relative to the barrel 104. The depending legs 218 of the spoon mount 204 define an internal boundary and a longitudinal boundary approximating the dimensions of the reduced barrel segment 118. The lock 216 further defines a central segment 242 with a curved internal surface 244 which contacts the reduced barrel segment 118 when the lock is in the secured position to further secure the spoon mount 204 about the reduced barrel segment 118.

The use of the curling apparatus 10 will now be discussed. The curling iron 100 with the clamp 200 mounted thereto may be used to treat hair in a conventional manner, e.g., the spoon 202 may be pivoted by depression of manual segment 206 to the open position of FIG. 2 and the end of a lock of hair positioned between the spoon 202 and the barrel 104. The manual segment 206 is released to return the clamp 200 and the spoon 202 under the bias of the torsion spring 212 in engagement with the barrel 104 thereby securing the lock of hair. The curling iron 100 is rotated on the hair to treat the hair and impart curls.

When it is decided to remove the clamp 200 to provide a clampless capability or mode to the curling iron 100, the lock 216 of the spoon mount 204 is pivoted from the locked position depicted in to the release position depicted in phantom in FIG. 7 and also shown in phantom in FIG. 9. As the lock 216 moves to the release position, the lock detent 236 disengages the lock shelf 238 of the mount base 214 thereby permitting removal of the clamp 200 from the barrel 104. The curling iron 100 without the clamp 200 is then applied to the hair, and hair is wrapped about the barrel 104 of the curling iron 100 for treatment.

Although the illustrative embodiments of the present disclosure have been described herein with reference to the accompanying drawings, the above description, disclosure, and Figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A hair curling apparatus, which comprises:

a handle;

a barrel depending from the handle and defining a longitudinal barrel axis, the barrel dimensioned to accommodate a lock of hair wrapped thereabout; and a clamp releasably mounted relative to one of the barrel or the handle, the clamp including:

a spoon mount dimensioned to releasably couple with the one of the barrel or the handle, the spoon mount having a mount base and a lock, the mount base including first and second spaced depending legs defining a gap therebetween for at least partially accommodating the one of the barrel or the handle, the lock being pivotally mounted to the first depending leg and adapted to pivot between a release position and a secured position, wherein, in the secured position, the lock securely engages the second depending leg thereby securing the spoon mount to the one of the barrel or the handle; and a spoon mounted to the spoon mount and adapted to move relative to the one of the barrel or the handle between a closed position and an open position, the spoon engaging the lock of hair when in the closed position;

wherein one of the barrel and the mount base includes a key and the other of the barrel and the mount base includes a key slot dimensioned to receive the key when the clamp is mounted to the barrel.

2. The hair curling apparatus according to claim 1 wherein the spoon mount is dimensioned to releasably couple with the barrel, the spoon pivotally mounted to the spoon mount.

3. The hair curling apparatus according to claim 1 wherein the lock includes a lock detent and the second depending leg of the mount base includes a lock shelf, the lock detent dimensioned to engage the lock shelf when in the secured position of the lock.

4. The hair curling apparatus according to claim 1 wherein the barrel defines a recessed barrel segment having a reduced cross-section, the first and second depending legs of the mount base at least partially accommodated within the recessed barrel segment when the clamp is mounted to the barrel.

5. The hair curling apparatus according to claim 4 wherein the first and second depending legs each define a longitudinal dimension approximating a longitudinal dimension of the recessed barrel segment.

6. The hair curling apparatus according to claim 1 wherein the spoon is adapted for pivotal movement between the closed position and the open position thereof.

7. The hair curling apparatus according to claim 6 wherein the spoon is normally biased to the closed position by a spring.

8. The hair curling apparatus according to claim 1 wherein the key and the key slot are dimensioned to cooperate to prevent rotational movement of the spoon mount relative to the barrel upon positioning of the mount base within the recessed barrel segment.

9. The hair curling apparatus according to claim 1 wherein the lock is pivotally mounted about a pivot axis, the pivot axis being substantially parallel to the longitudinal barrel axis.

10. The hair curling apparatus according to claim 1 wherein the lock is free from bias toward both the release position and the secured position.

11. A hair curling apparatus, which comprises:

a handle;

a barrel depending from the handle and defining a longitudinal barrel axis, the barrel dimensioned to accommodate a lock of hair wrapped thereabout; and a spoon adapted to move relative to the barrel between a closed position and an open position, the spoon engaging the lock of hair when in the closed position; and a spoon mount to which the spoon is mounted, the spoon mount including a mount base and a lock, the mount base having first and second spaced depending legs dimensioned to at least partially accommodate the barrel, the lock being pivotally mounted to the first depending leg and having a lock detent, the lock adapted to pivot between a release position permitting removal of the spoon mount and the spoon from the barrel and a secured position where the lock detent of the first depending leg engages a lock shelf of the second depending leg thereby securing the spoon mount to the barrel.

12. The hair curling apparatus according to claim 11 wherein the barrel includes a recessed barrel segment adjacent the handle defining a reduced cross-sectional dimension or diameter relative to a corresponding cross-sectional dimension or diameter of a remaining segment of the barrel, the recessed barrel segment of the barrel dimensioned to at least partially accommodate the mount base.

13. The hair curling apparatus according to claim 12 wherein the first and second depending legs are dimensioned and positioned to receive the recessed barrel segment upon positioning of the mount base within the recessed barrel segment.

14. The hair curling apparatus according to claim 13 wherein the first and second depending legs each define a longitudinal dimension approximating a longitudinal dimension of the recessed barrel segment.

15. The hair curling apparatus according to claim 11 wherein the lock is adapted to pivot about a pivot axis between the release position and the secured position, the pivot axis in general parallel relation with the longitudinal axis of the barrel.

16. A hair curling apparatus, which comprises:

a handle;

a barrel depending from the handle and defining a longitudinal barrel axis, the barrel dimensioned to accommodate a lock of hair wrapped thereabout, the barrel including a recessed barrel segment adjacent the handle defining a reduced cross-sectional dimension or diameter relative to a corresponding cross-sectional dimension or diameter of a remaining segment of the barrel;

a spoon adapted to move relative to the barrel between a closed position and an open position, the spoon engaging the lock of hair when in the closed position; and a spoon mount to which the spoon is mounted, the spoon mount including a mount base and a lock, the mount base having first and second spaced depending legs dimensioned to be received within the recessed barrel segment of the barrel upon positioning of the mount base within the recessed barrel segment, the first and second depending legs each defining a longitudinal dimension approximating a longitudinal dimension of the recessed barrel segment, the lock being pivotally mounted to the first depending leg and having a lock detent, the second depending leg includes a lock shelf, the lock adapted to pivot between a release position permitting removal of the spoon mount and the spoon from the barrel and a secured position where the lock detent engages the lock shelf thereby securing the spoon mount to the barrel.

* * * * *